US005180296A

United States Patent [19]

Mehling

[11] Patent Number: 5,180,296

[45] Date of Patent: Jan. 19, 1993

[54] HYDRAULIC MACHINE HAVING AXIAL USER PORTS

[75] Inventor: Horst Mehling, Lohr, Fed. Rep. of Germany

[73] Assignee: Mannesmann Rexroth GmbH, Lohr, Fed. Rep. of Germany

[21] Appl. No.: 798,997

[22] Filed: Dec. 2, 1991

Related U.S. Application Data

[63] Continuation of Ser. No. 496,583, Mar. 21, 1990.

[30] Foreign Application Priority Data

Mar. 21, 1989 [DE] Fed. Rep. of Germany ..... 3909259

[51] Int. Cl.[5] ..... F01C 1/10; F01C 21/12

[52] U.S. Cl. ..... 418/61.3; 418/181

[58] Field of Search ..... 418/61.3, 181

[56] References Cited

U.S. PATENT DOCUMENTS

| | | | |
|---|---|---|---|
| 3,512,905 | 5/1970 | Waldorff | 418/61.3 |
| 4,575,321 | 3/1986 | Peterson et al. | 418/61.3 |
| 4,818,200 | 4/1989 | White, Jr. | 418/61.3 |
| 4,877,383 | 10/1989 | White, Jr. | 418/61.3 |

FOREIGN PATENT DOCUMENTS

| | | | |
|---|---|---|---|
| 2015897 | 10/1971 | Fed. Rep. of Germany . | |
| 1703406 | 3/1972 | Fed. Rep. of Germany . | |
| 1728617 | 2/1977 | Fed. Rep. of Germany | 418/61.3 |
| 3015551 | 10/1981 | Fed. Rep. of Germany . | |
| 3119807 | 12/1982 | Fed. Rep. of Germany . | |
| 3243404 | 5/1984 | Fed. Rep. of Germany | 418/61.3 |
| 3243405 | 5/1984 | Fed. Rep. of Germany | 418/61.3 |
| 59-41688 | 3/1984 | Japan | 418/61.3 |

OTHER PUBLICATIONS

Mannesmann Rexroth Prospectus RD 14 335/6.86, Jan. 1986, pp. 1-8.

*Primary Examiner*—Richard A. Bertsch
*Assistant Examiner*—David L. Cavanaugh
*Attorney, Agent, or Firm*—Cushman, Darby & Cushman

[57] ABSTRACT

A circular piston engine or machine is provided having a rotor with outer teeth and fixedly connected for rotation with the shaft. The rotor cooperates with an outer gear having inner teeth. The outer gear is supported by the housing at its outside and the user ports extend axially in the control housing.

16 Claims, 5 Drawing Sheets

HYDRAULIC MACHINE HAVING AXIAL USER PORTS

This is a continuation of application Ser. No. 07/496,583, filed on Mar. 21, 1990, which was abaonded upon the filing hereof.

TECHNICAL FIELD

This invention relates generally to a hydraulic machine and, more particularly, to a displacement type hydraulic motor, in which the rotary moment is generated directly at a centrally supported shaft. A hydraulic moeor to which the present invention particularly percains comprises in suostance a control housing together with a commutator fixedly mounted with respect to said housing, a flange, a shaft, an intermediate housing, and a displacement unit together with a rotor, a hollow wheel, inner rollers, outer rollers and a control disc. The inner rollers and the outer rollers can also be part of the rotor and intermediate housing, respectively. The control disc can be a part of the rotor.

Hydraulic motors of the above mentioned type are known from the prospectus RD 14 335/6.86 of Mannesmann Rexroth GmbH. For said known hydraulic motor tne user or working ports extend in radial direction from the control housing so as to supply the moror with pressure medium and to remove the pressure medium from the motor.

Additional prior art is shown in the following German Offenlegungsschrifts: DE-OS 30 15 551, DE-OS 20 15 897, DE-0S 31 19 807 and DE-OS 17 03 406.

Inasmuch as hydraulic motors are used for quite different applications, frequently space problems occur due to the radially extending user ports of the motor. This leads to undesirable changes in the design in which the hydraulic motor is to be used. Also, the known motors with radially extending user ports can create difficulties, when mounting connecting elements to said user ports.

It is an object of the present invention to provide a hydraulic machine, in particular a motor of the type set forth above such that the motor can be readily installed even if space is at a premium.

It is another object of the invention to provide a hydraulic motor of the type mentioned above such that the geometric location of the user or working ports, including the leakage oil port, readily allow the maintencance, i.e. the installment and the removal of standard connecting elements at said ports.

Generally, the present invention is directed to overcome the problems of the prior art.

It is a more specific object of the present invention to design a hydraulic motor having axially extending user ports such, that the connection of said ports to the working space of the hydraulic moror is provided in a simple manner, particularly from a viewpoint of manufacturing.

DISCLOSURE OF THE INVENTION

In one aspect of the present invention a hydraulic machine, in particular a hydraulic motor is provided comprising: a rotor, a shaft with which said rotor is fixedly mounted for rotation, an outer gear having inner teeth for cooperation with said rotor, a housing adapted to support said outer gear from the outside, a control apparatus mounted sideways with respect to said rotor and said outer gear and having control slots which are connected with axially extending supply and discharge bores, respectively, said supply and discharge oores being provided in a connecting body which is located in a housing member, wherein said supply and discharge bores end in an outer area of said connecting body in recesses provided in said housing member, said recesses being in turn connected with user or working ports, said working ports being located axially in said controll housing. Preferably, said axial working or user ports located in said control housing can be provided in addition to the already existing radially extending working or user ports. Those ports which are not used are blocked.

In a second aspect of the present invention the connection of the axially extending user ports to the commutator is provided oy channels in the control housing. In particular, the design is such that one of said channels meets one of the control slots of the commutator which extends through it, while the other channel meets one of the control slots which does not completely extend through the commutator, wherein in the last mentioned situation a special opening is provided, which extends through the commutator.

In accordance with the invention not only the pressure medium is axially directed to the working space by means of the axially extending working ports, but also the leakage oil port extends axially in the control housing. Said leakage oil port is connected via respective channels with the inner space of the motor.

The commutator, which is provided with the special bore for connecting the one working or user port with the control slot which does not fully extend through the commutator, can be used for hydraulic motors with axial and/or radial ports.

The control housing having axial ports can be used for all motors for which the control part (i.e. the control disc and the commutator) are on the opposite side to the exit side of the shaft. Another advantage of the present invention resides in the possibility of mounting valve apparatus of any kind on the axial mounting surface of the motor.

In a third aspect of the present invention the connection between the user ports and the working space can be provided such that easy manufacturing is possible. To this end the connection of the axial user ports to the working space is provided directly via a control slot and recesses in the control housing. Each one control slot serves for the supply and the removal of the operating fluid (pressure medium) to the respective ports.

Thus, the hydraulic motor invention can be provided with pressure medium in a simple manner if space problems exist in radial direction.

BRIEF DESCRIPTION OF THE DRAWINGS

For a better understanding of the present invention, reference may be made to the accompanying drawings in which.

Figure 1:
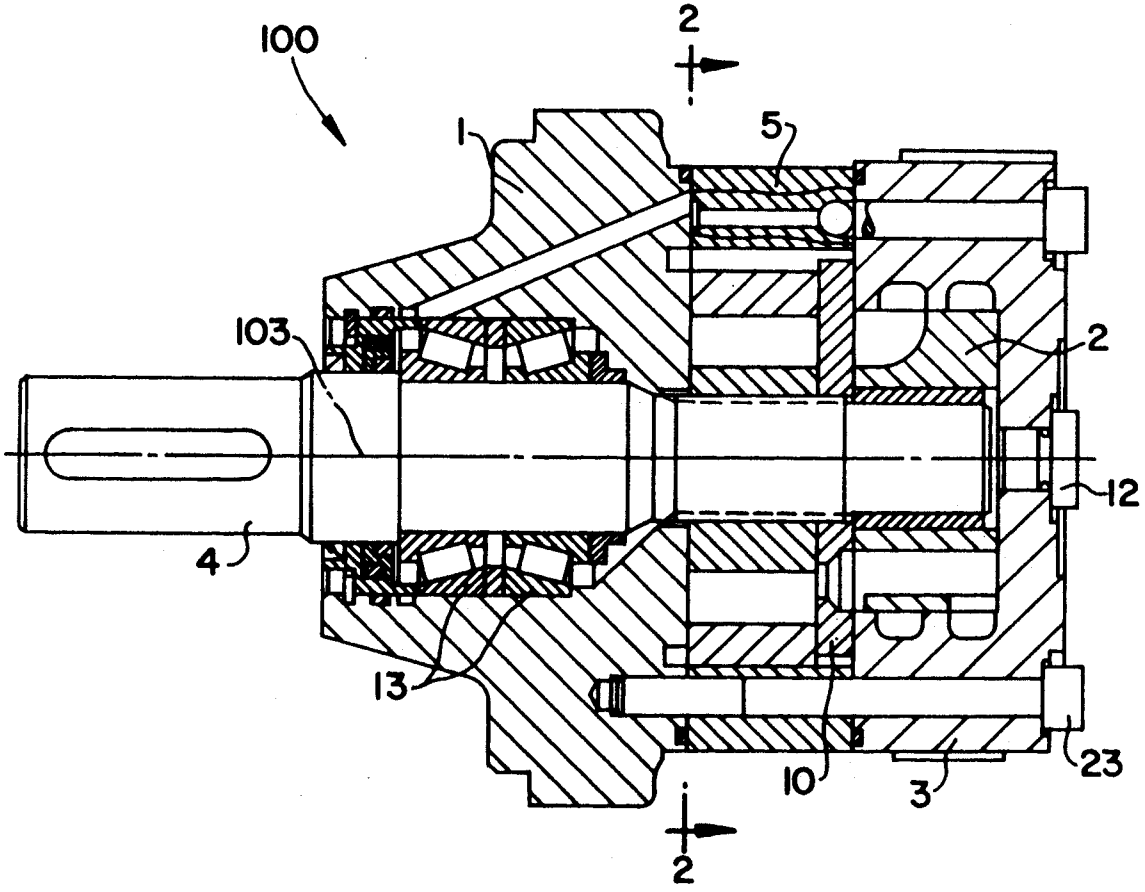
FIG. 1 (PRIOR ART)
FIG. 1 is a longitudinal sectional view of a hydraulic motor of the prior art.
Figure 2:
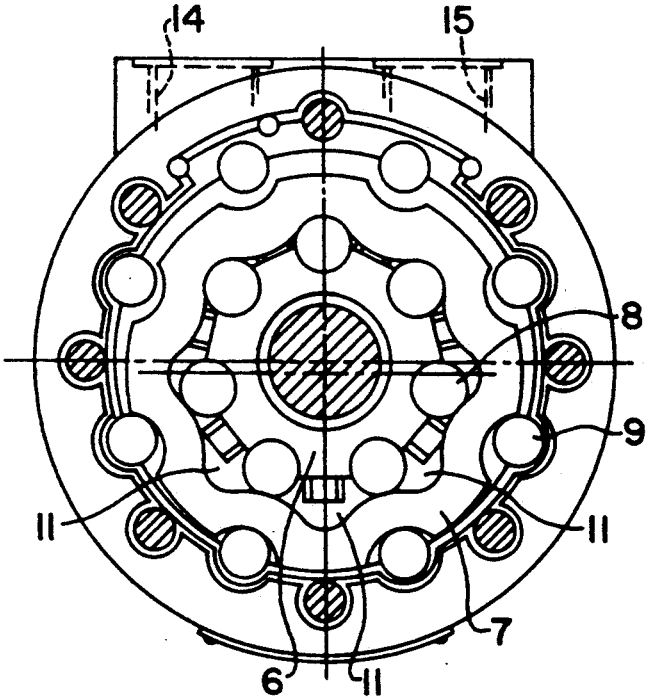
FIG. 2 (PRIOR ART)
FIG. 2 is a sectional view along line 2—2 in FIG. 1.
Figure 3:
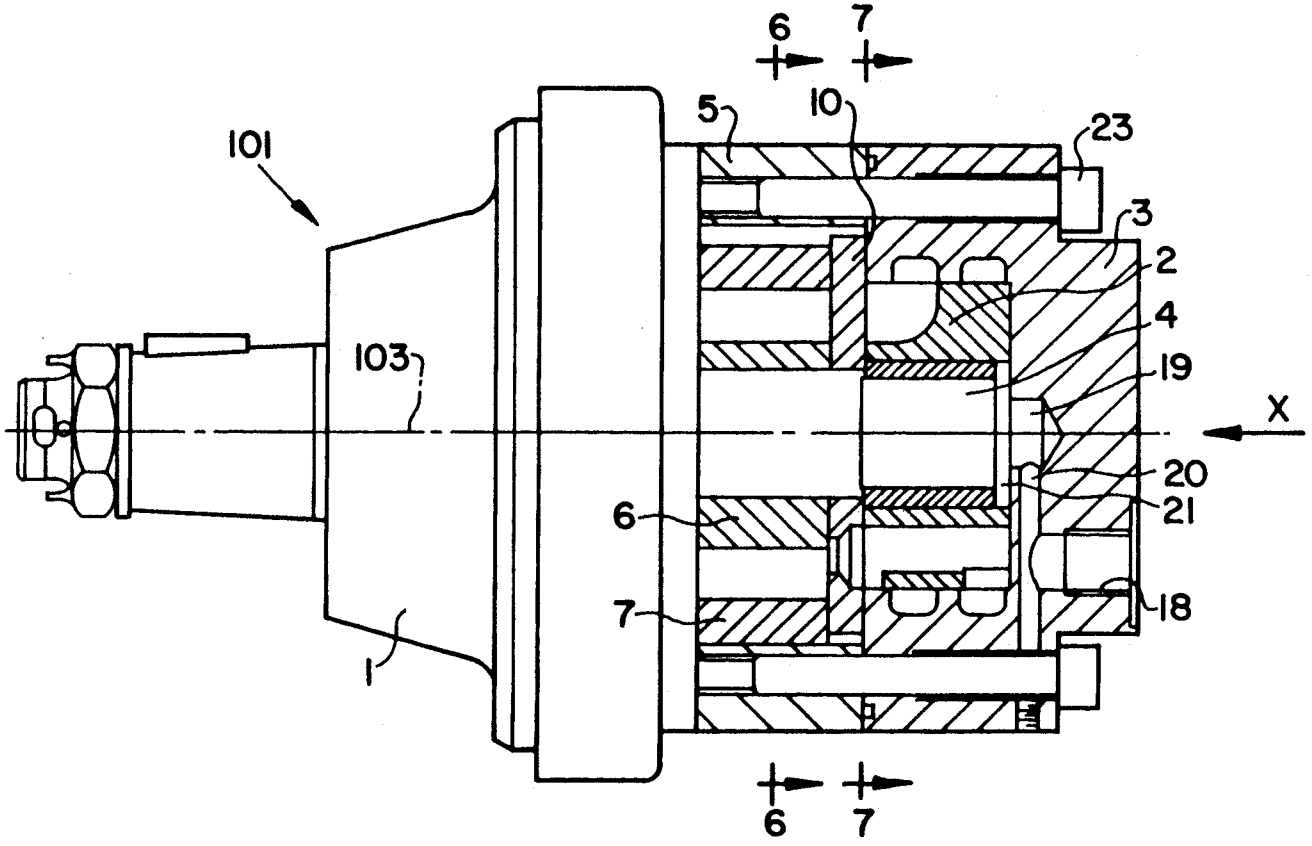
FIG. 3 is a partial sectional view along line 3—3 in FIG. 7 and a side elevational view of a hydraulic motor of the invention.
Figure 4:
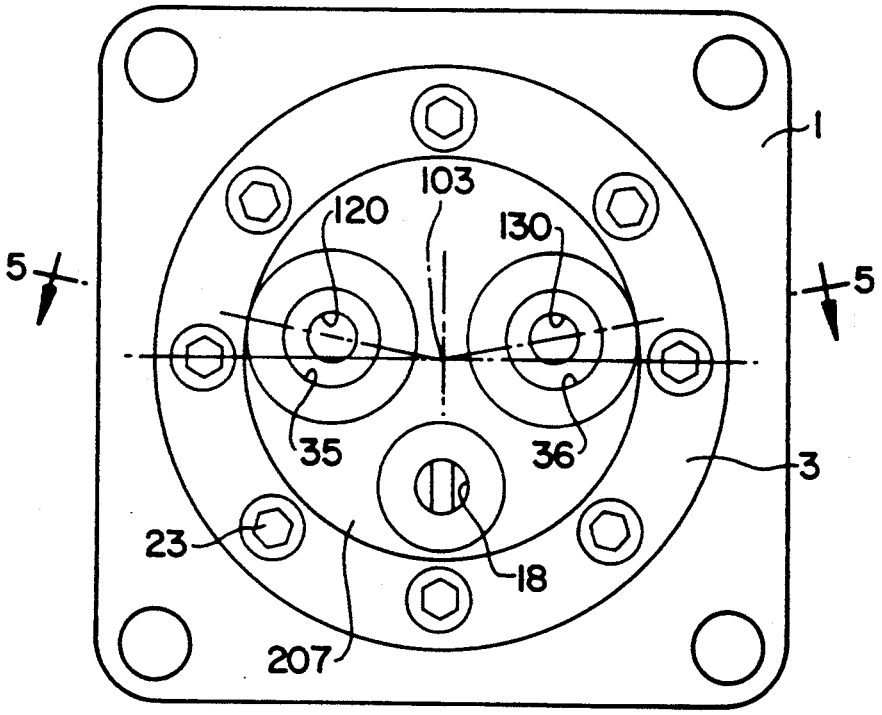
FIG. 4 is a side elevational view seen from the direction of the arrow X in FIG. 3.

Refering now to FIG. 1 and 2, a hydraulic motor 100 of the prior art is shown. The principle of displacement used for such a motor 100 generates the rotary moment directly ar a centrally located shaft 4 which extends along the longitudinal axis 103 of said motor. The hydraulic motor 100 comprises in substance a control housing 3 with a commutator 2 fixed thereto. The hydraulic motor 100 further comprises a flange 1, the shaft 4 already mentioned, an intermediate housing 5, a displacement unit and a control disc 10. The displacement unit includes a rotor 6, a hollow wheel 7, inner rollers 8 and outer rollers 9. Bolts 23 connect flange 1, intermediate housing 5 and control housing 3. The supply and discharge of the pressure medium occurs via the user or working ports 14 and 15, respectively. The pressure medium (preferably hydraulic o:1) present at the user ports 14 and 15 is in connection with the commutator via annular channels, not referred to in detail. Due to the cooperation between the control slots of the commutator 2 and the control disc 10, rotating together with the shaft 4, the pressure medium is guided into and out of the displacement chambers 11 (working spaces) of the motor. The number of the momentary displacement chambers 11 corresponds to the number of the inner rollers 8. About half of these three or four rotating displacement chambers 11 is under pressure and causes a force on the rotor 6 creating a rotary moment. A "slow" rotary movement is carried out by the rotor 6 about the longitudinal axis 103 of the motor which is coincident with the axis of the shaft 4, while the hollow wheel 7 carries out a "fast" circular movement about the axis 103 of the shaft. As a consequence, a large number of displacement operations occurs for each rotation of the shaft. The number of the displacement chambers for each rotation of the shaft is the product of the number of the inner rollers 8 and the number of the cycloide teeth of the hollow wheel 7. The outer rollers 9 support and guide the hollow wheel 7. Leakage oil is fed back via internal check valves to the respective low pressure port. High external forces are taken up by a bearing 30 of cone shaped rollers.

FIG. 3 through 7 disclose an embodiment of a hydraulic motor 101 of the invention. The hydraulic moto 101 has in substance the same design as the hydraulic motor 100, so that for a description of the hydraulic motor 101 reference may be made to the description of the hydraulic motor 100. Wherever possible like reference numerals are used for motors 100 and 101, respectively.

In accordance with the present invention the hydraulic motor is provided with axially extending user ports 35 and 36.

"Axially extending" means that the user ports do not extend more or less in radial direction, as is true for the prior art as shown in FIG. 2, but the user ports according to the invention extend in substance parallel to the longitudinal axis 103 of the motor. As can be clearly recognized in FIG. 5 the two axial user ports 35 and 36 are provided at the end face of the control housing 3, and said ports are thus readily accessible after the hydraulic motor 101 has been installed.

The connection of the user ports 35 and 36 with the commutator 2 is provided by a channel 120 and a channel 130, respectively, in the control housing 3. The interface to the commutator 2 is designed as follows: the one channel 120 meets a control slot 141 which extends (all the way) through the commutator 2; the other channel 130 meets a specially opened control slot 151, i.e. in the area of the channel 130, the commutator material which would normally be present at this location is penetrated by a channel 50.

The control slots 151 to 158—in the embodiment shown 8 control slots are present—are connected with each other by means of a recess 170 in the control housing 3. The recess 170 preferably corresponds to the respective ring channel of the hydraulic motor 100 shown in FIG. 1.

Moreover, the control slots 141 through 148, which again number 8, are connected with each other by means of another recess 160 in the control housing 3. Again recess 160 preferably corresponds to the other ring channel shown in FIG. 1.

Figure 5:
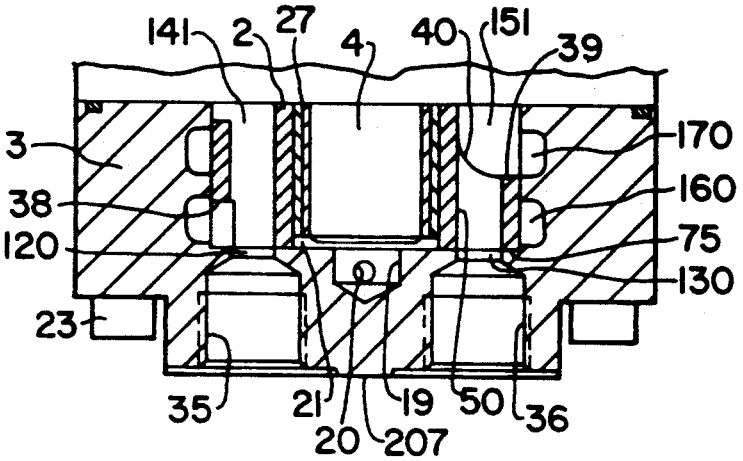
FIG. 5 is a cross-sectional view along line 5—5 in FIG. 4.
Figure 6:
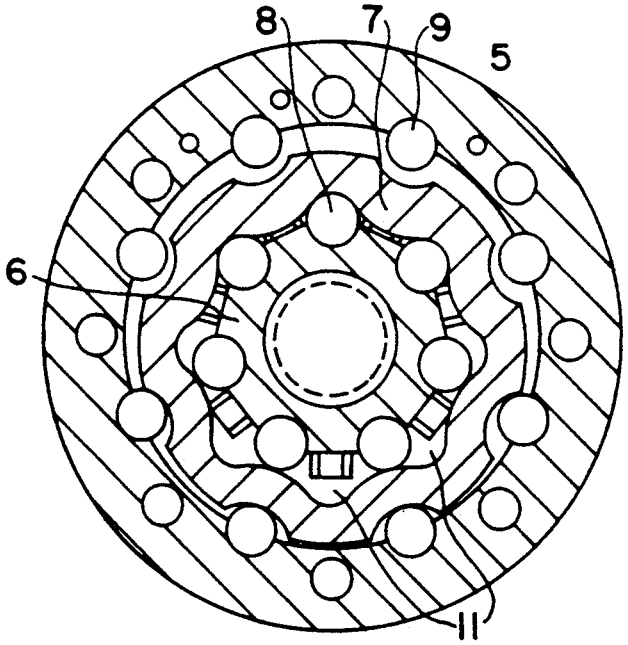
FIG. 6 is a cross-sectional view along line 6—6 in FIG. 3.
Figure 7:
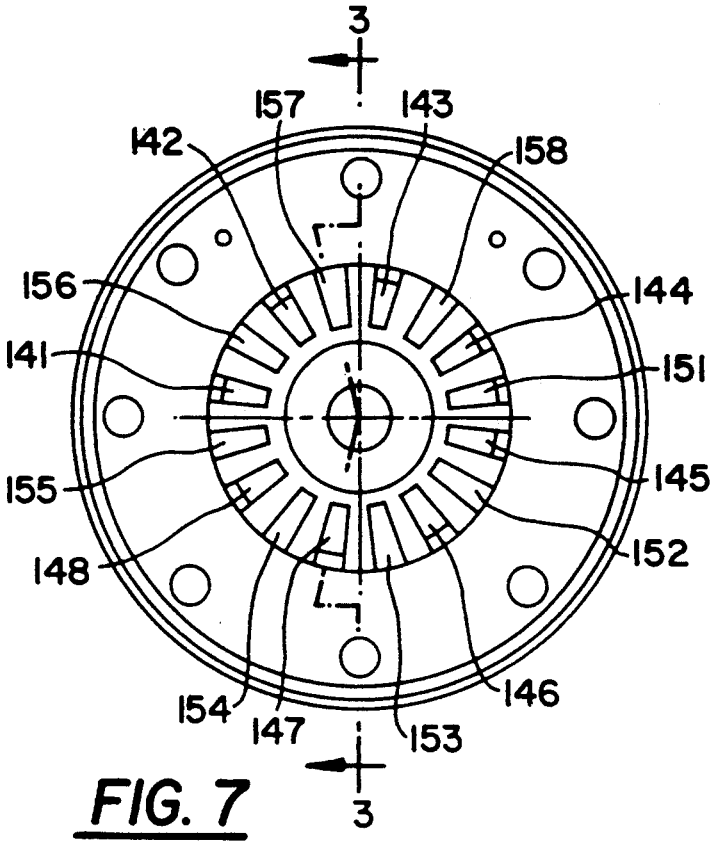
FIG. 7 is a cross-sectional view along line 7—7 in FIG. 3.

Due to the arrangement of the invention according to which axial user ports 35 and 36 are provided, and due to their connection with the commutator, it is possible to provide one and the same motor with radial ports 14 and 15 as shown in FIG. 2 and axial user ports 35 and 36 as shown in FIG. 5, even though this is not specifically shown. It is further possible that the commutator 2 shown in FIG. 5—which has compared with the commutator of FIG. 1 an additional channel 5—is used together with motors having axial and/or radial user ports. Further, the control housing 3 of FIG. 5 having axial ports can be the same for all motors, i.e. also motors having radial ports as long as the control part (i.e. control disc and commutator) are on the opposite side of the exit of the shaft.

In accordance with the invention the leakage oil port 18 extends axially in the control housing 3. The leakage oil port 18 is connected with the inner space 21 of the motor via channels 19 and 20.

FIG. 5 shows a bearing 27 for the shaft. Moreover, for the slot 141 fully extending through the commutator, an opening ,38 can be seen which creates the connection to the recess 160. With respect to slot 150 one can recognize channel 50, which extends from the end face 75 of the commutator and transverses a curved end surface 40 of the slot 151. An edge 39 is in alignment with the side wall of recess 170.

The above explained displacement principle using a rotor, a hollow wheel, an intermediate housing, an inner roller, and outer roller and a control disc can also be used in the following design:

a) rotor and control disc are one part, b) rotor and inner roller are one part, c) rotor, inner roller and control disc are one part and d) intermediate housing and outer rollers are one part.

For the above listed designs it is also possible to use the axial user ports.

As a matter of principle, the control slots 141 and 148 do not have to extend completely through the commutator. For reasons of manufacturing, however, the control slots 141 to 148 fully extend through the commutator. The control slots 141 to 148 always have to be connected with the recess 160. In case that the slots 141 to 148 are not fully extending through the commutator a breakthrough (passage) 120 to the port 35 is necessary.

The above description was primarily directed to the use of the invention for a motor. However, the invention is also applicable for circular piston engines :n general, specifically pumps.

Another advangage of the engine 1 of FIG. 3 to 7 is the provision of a connecting surface 207 adjacent to the two axially extending user ports 35 and 36. This opens up the possibility of locating a valve apparatus at said axial connecting surface 207.

I claim:

1. A hydraulic machine comprising:

a housing, a rotor rotatably mounted in said housing, said rotor having outer teeth, a shaft to which said rotor is fixedly mounted for rotation therewith, an outer gear rotatably mounted having inner teeth for cooperation with said outer teeth of said rotor, said housing being adapted to support said outer gear from the outside, a commutator mounted sideways with respect to said rotor and said outer gear with a control disc therebetween, said commutator having a plurality of control slots, said control slots forming a first group and second group, said commutator being stationary with respect to said housing, supply and discharge bores provided in said control disc, a control housing for receiving said commutator and mounted to said control housing, a first ring chnanel and a second ring channel axially spaced in said control housnig, said first and second ring channels extending radially and surrounding said commutator, user ports disposed in said control housing, wherein said commutator is configured to allow said user ports to extend from said housing in an axial or radial direction.

2. The machine of claim 1, wherien said housing comprises a control housing thereto an intermediate housing, and a flange adjacent to said intermediate housing, said outer gear being located in said intermediate housing, and said shaft being rotatably mounted in said flange.

3. The machine of claim 1, wherein the interfaces or transitions from the channels to the commutator are designed such that the one channel preferably hits a control slot extending through the commutator while the other channel hits a specially opened control slot (e.g.).

4. The machine of claim 3, wherein one group of the control slots are connected to each other by means of a recess in the control housing.

5. The machine of claim 4, wherein the other group of control slots are connected to each other by means of a recess in the control housing.

6. The machine of claim 5, wherein the control slots of the one group completely penetrate the commutator in axial direction while the other group of control slots does not penetrate the commutator in axial direction, wherein one control slot of said other group of control slots provides a connection axially penetrating the commutator via bore.

7. The machine of claim 2, wherein a leakage port extends axially in the control housing and is connected via channels with the inner space of the machine.

8. The machine of claim 1, wherein the commutator located in said control housing can be used for machiens having axial or radial ports.

9. The machine of claim 1, wherein an axially extending connecting surface is provided which provides for the mounting of a valve apparatus at said axial connecting surface.

10. The machine of claim 1, wherein the rotor forms together with at least one of the inner rollers and the cotnrol disc one part.

11. The machine of claim 2, wherein the intermediate housing and the outer rollers form one part.

12. A hydraulic machine according to claim 1, wherein said user ports extend axially.

13. A hydraulic machine according to claim 1, wherein said user ports extend radially.

14. A hydraulic machine according to claim 1, wherein said first group formed by the control slots completely penetrates the commutator in an axial direction while the second group of control slots does not penetrate the commutator in the axial direction.

15. A hydraulic machine according to claim 1, wherein one control slot of said second group of control slots provides a connection that axially penetrates the commutator via a bore.

16. A hydraulic machine according to claim 1, wherein channels are formed in said housing for connecting at least one of said first group of control slots with the respective one of said user ports, and for connecting said bore to said respective user port.

* * * * *